US007328736B2

(12) United States Patent
Hunter et al.

(10) Patent No.: US 7,328,736 B2
(45) Date of Patent: Feb. 12, 2008

(54) AUTOMATED CLAMPING MECHANISM AND MOLD FLASK INCORPORATING SAME

(75) Inventors: William A. Hunter, Naples, FL (US); William G. Hunter, North Barrington, IL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 0 days.

(21) Appl. No.: 11/601,122

(22) Filed: Nov. 17, 2006

(65) Prior Publication Data

US 2007/0062667 A1 Mar. 22, 2007

Related U.S. Application Data

(62) Division of application No. 10/935,065, filed on Aug. 31, 2004, now Pat. No. 7,150,310.

(51) Int. Cl.
*B22C 21/08* (2006.01)

(52) U.S. Cl. ..... 164/386; 164/374; 164/393

(58) Field of Classification Search ..... 164/386, 164/374, 393

See application file for complete search history.

(56) References Cited

U.S. PATENT DOCUMENTS

| | | | | |
|---|---|---|---|---|
| 167,890 | A | 9/1875 | Garrett | |
| 1,447,599 | A | 3/1923 | Oakley | |
| 1,746,146 | A | 2/1930 | Diehl | |
| 2,223,563 | A | 12/1940 | Hines | |
| 2,611,162 | A | 9/1952 | Ernst et al. | |
| 2,732,599 | A | 1/1956 | Hines | |
| 2,761,201 | A | 9/1956 | Sylvester | |
| 3,368,609 | A | 2/1968 | Wood | |
| 3,664,408 | A | 5/1972 | Eibe | |
| 3,983,926 | A | 10/1976 | Muller | |
| 4,840,218 | A | 6/1989 | Hunter | |
| 4,890,664 | A | 1/1990 | Hunter | |
| 5,022,512 | A | 6/1991 | Hunter | |
| 5,101,881 | A | 4/1992 | Hunter | |
| 5,170,836 | A | 12/1992 | Hunter | |
| 6,499,531 | B1 * | 12/2002 | Knudsen | 164/211 |
| 6,622,772 | B1 | 9/2003 | Hunter | |
| 7,150,310 | B2 * | 12/2006 | Hunter et al. | 164/386 |

* cited by examiner

*Primary Examiner*—Kevin P. Kerns
(74) *Attorney, Agent, or Firm*—Leydig, Voit & Mayer, Ltd.

(57) ABSTRACT

A mold flask assembly is provided with a novel clamping mechanism for clamping a pattern plate in the mold flask assembly of an automated molding machine. The clamping mechanism comprises a first clamp abutment and a clamping head extending along an axis. The clamping head provides a second clamp abutment. The first and second clamp abutments engage each other in a clamped position. The first and second clamp abutments are spaced along the axis and angularly displaced in a released position. A combination rotary and linear actuator is operative to facilitate relative linear translation and rotation between the rod and the bushing to move between the clamped and released positions.

20 Claims, 15 Drawing Sheets

AUTOMATED CLAMPING MECHANISM AND MOLD FLASK INCORPORATING SAME

CROSS-REFERENCE TO RELATED APPLICATIONS

This patent application is a divisional of U.S. patent application Ser. No. 10/935,065, filed Aug. 31, 2004, now U.S. Pat. No. 7,150,310.

FIELD OF THE INVENTION

This invention pertains to automated clamping mechanisms and mold flask assemblies for creating sand molds, and more particularly relates to actuated automated clamping mechanisms and apparatus for clamping pattern plates in mold flask assemblies.

BACKGROUND OF THE INVENTION

Foundries use automated matchplate molding machines to produce large quantities of green sand molds which in turn create metal castings. As is well known, sand molds typically comprise two halves, including a cope situated vertically on top of a drag. The cope and drag are separated by a horizontal parting line and define an internal cavity for the receipt of molten metal material. Sand cores may be placed in the internal cavity between the cope and the drag to modify the shape of metal castings produced by the sand molds. The cope mold has a pouring sprue to facilitate pouring of molten metal into the internal cavity of the mold. Once molten metal is received in a sand mold, it is allowed to cool and solidify. Then, the sand mold can be broken apart to release the formed metal castings.

Although manual operations exist for creating sand molds, the modern way to form sand molds is through automated matchplate molding machines. Modern automated matchplate molding machines for creating sand molds are disclosed in the following patents to William A. Hunter, U.S. Pat. Nos. 5,022,512, 4,840,218 and 4,890,664, each entitled "Automatic Matchplate Molding System", which are hereby incorporated by reference in their entireties. These patents generally disclose automated machinery that utilizes a flask assembly comprised of a drag flask, a cope flask, and a matchplate (also known as a "pattern plate") therebetween. The flask assembly is successively and automatically assembled, filled with sand and unassembled to form sand molds.

With advances in automated mold handling machinery, sand molds can be made very rapidly. In turn, production rates at foundries have increased several times. As a result of this increased productivity, often times it will be desirable to switch pattern plates several times during a work day as different casting orders are filled. By frequently switching pattern plates, several different jobs and castings can be completed by a molding machine to fill several different orders. However, there is a substantial amount of downtime involved with switching different pattern plates for different jobs. Pattern plates are typically bolted into the mold flask assembly, usually onto the drag flask. Manual labor is required to manually fasten and unfasten the bolts. If an automated molding machine is servicing many different jobs, this can result in several minutes or even hours of downtime during a work day.

Another type of automated matchplate molding machine is disclosed in U.S. Pat. No. 6,622,772, the entire disclosure of which is hereby incorporated by reference. This molding machine includes a turn table that rotates two mold flasks between a mold unload/service station and a flask filling station. In this machine the cope flask and the drag flask are bolted together by a bolt, which secures the pattern plate therebetween. A bolster plate, which is mounted to the turntable, supports the pattern plate during mold release operations. Automatic screwdrivers are actuated into and out of position to fasten and unfasten the bolt. While this has eliminated manual fastening and unfastening operations, the automatic screw driver concept relates to a different type of molding machine and has proved to have some reliability concerns.

BRIEF SUMMARY OF THE INVENTION

One aspect of the present invention is directed toward a mold flask assembly with an automated clamping mechanism for clamping a pattern plate in the mold flask assembly of an automated molding machine. The apparatus comprises a cope flask; a drag flask; and a pattern plate that is adapted to be positioned between the cope flask (with a pattern thereon for creating a cavity in a sand mold). The apparatus further comprises at least one automated clamping mechanism (and preferably two or more automated clamping mechanisms on opposed sides for balance) for clamping the pattern plate to at least one of the cope flask and the drag flask. The automated clamping mechanism includes an actuator driving a clamp. The actuator is mounted to one of the drag and cope flasks and has a released position and a clamped position. The clamp clamps the pattern plate in the clamped position and allows release of the pattern plate in the released position.

The present invention may be incorporated into the automated mold handling machines of any the patents that have been incorporated by reference, and other such automated mold handling machines.

Another aspect of the present invention is directed toward a novel clamping apparatus for clamping two or more bodies together. The apparatus comprises a first clamp abutment and a rod extending along an axis and past the first clamp abutment. The rod includes a clamping head providing a second clamp abutment. The first and second clamp abutments engage each other in a clamped position. The first and second clamp abutments are spaced along the axis and angularly displaced in a released position. A combination rotary and linear actuator is operative to facilitate relative linear translation and rotation between the clamp abutments to move between the clamped and released positions.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Referring to FIGS. 1-13, a first embodiment of the present invention has been shown as a clamping mechanism 10 installed on a drag flask assembly for releasably securing a drag flask 12 and a cope flask 14 together, and thereby clamping a pattern plate 16. The pattern plate 16 carries a pattern that is designed to form a cavity in a cope sand mold and a drag sand mold, which can then be filled with molten metal and cooled to form a metal casting.

Figure 13:
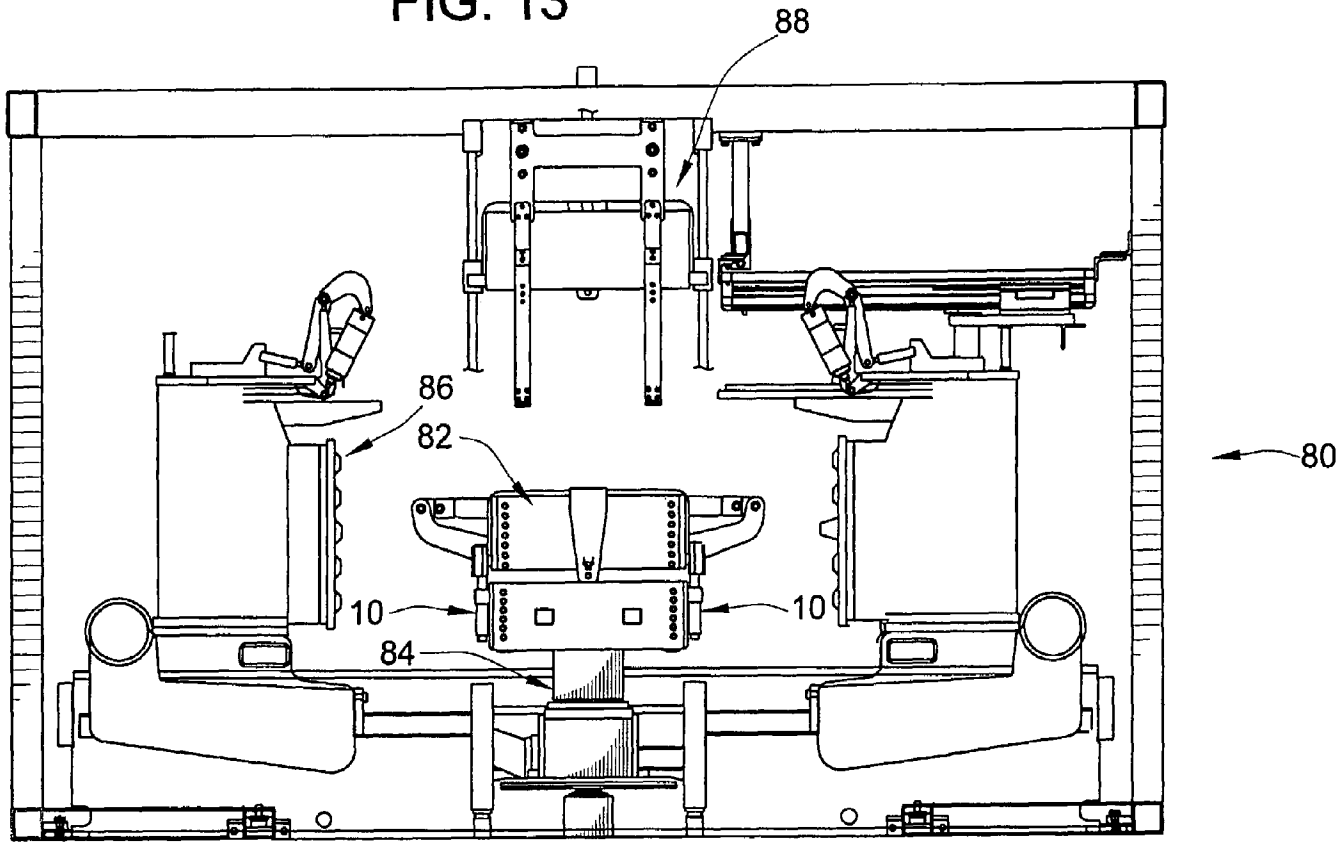
FIG. 13 is a partly schematic illustration of an automated matchplate molding machine incorporating the first embodiment with details removed to better illustrate the invention.
Figure 14:
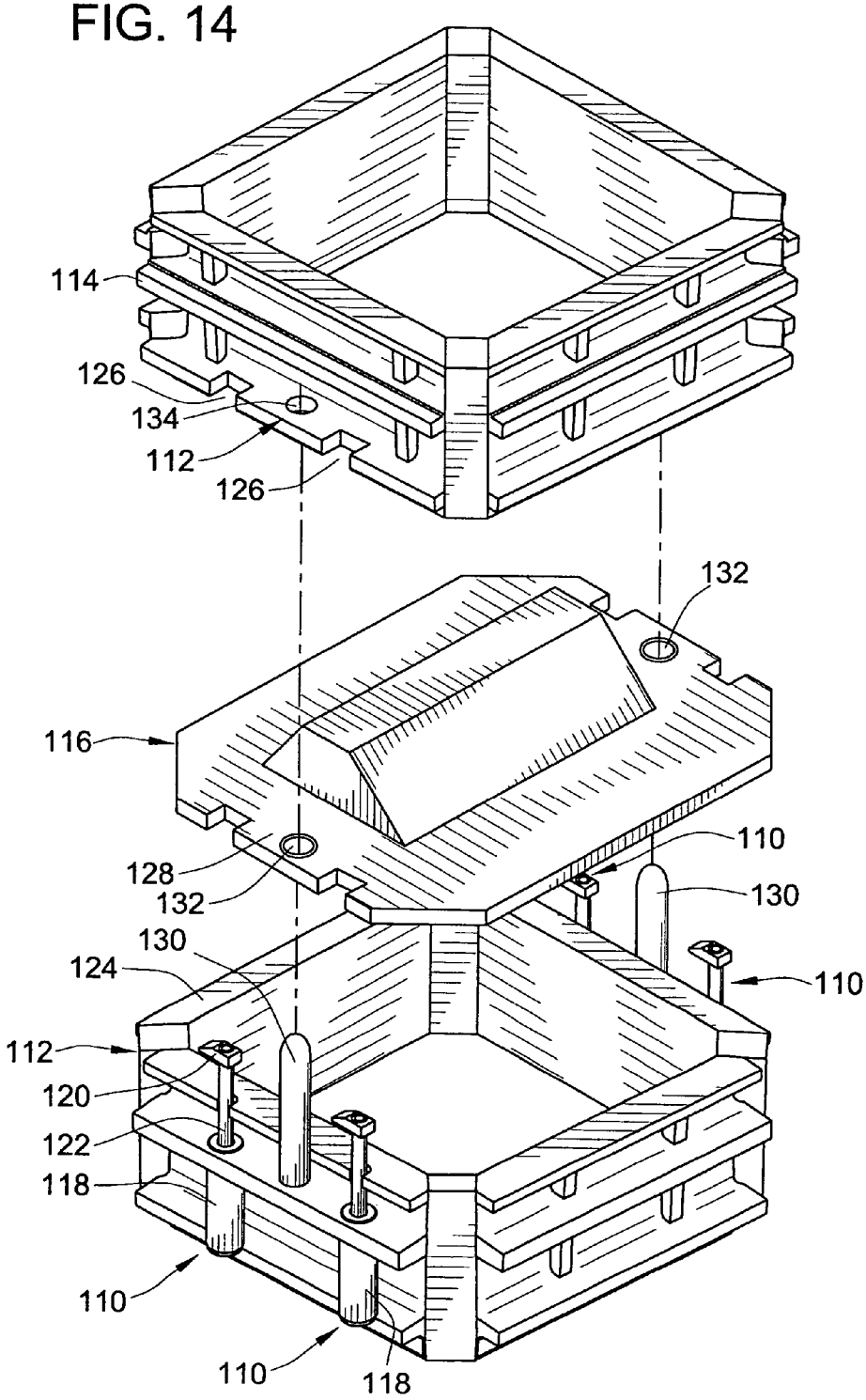
FIG. 14 is a side view of a mold flask assembly incorporating an automated clamping mechanism according to a second embodiment of the present invention, in which the clamping mechanism releasably secures the pattern plate to the drag flask.

The clamping mechanism 10 is particularly suited for use in successively securing and releasing the cope flask 14 and drag flask 12 in an automated mold making machine shown in U.S. Pat. No. 6,622,722 and as depicted in FIG. 13 herein. As shown in FIG. 13, the clamping mechanism 10 replaces the nut and bolt on the flask assembly, and can eliminate the automated screwdriver and positioning actuators for the same on the frame of the machine. However, it will be appreciated that the clamping mechanism 10 may have additional application beyond that depicted in FIG. 13 and other drawings.

Figure 11:
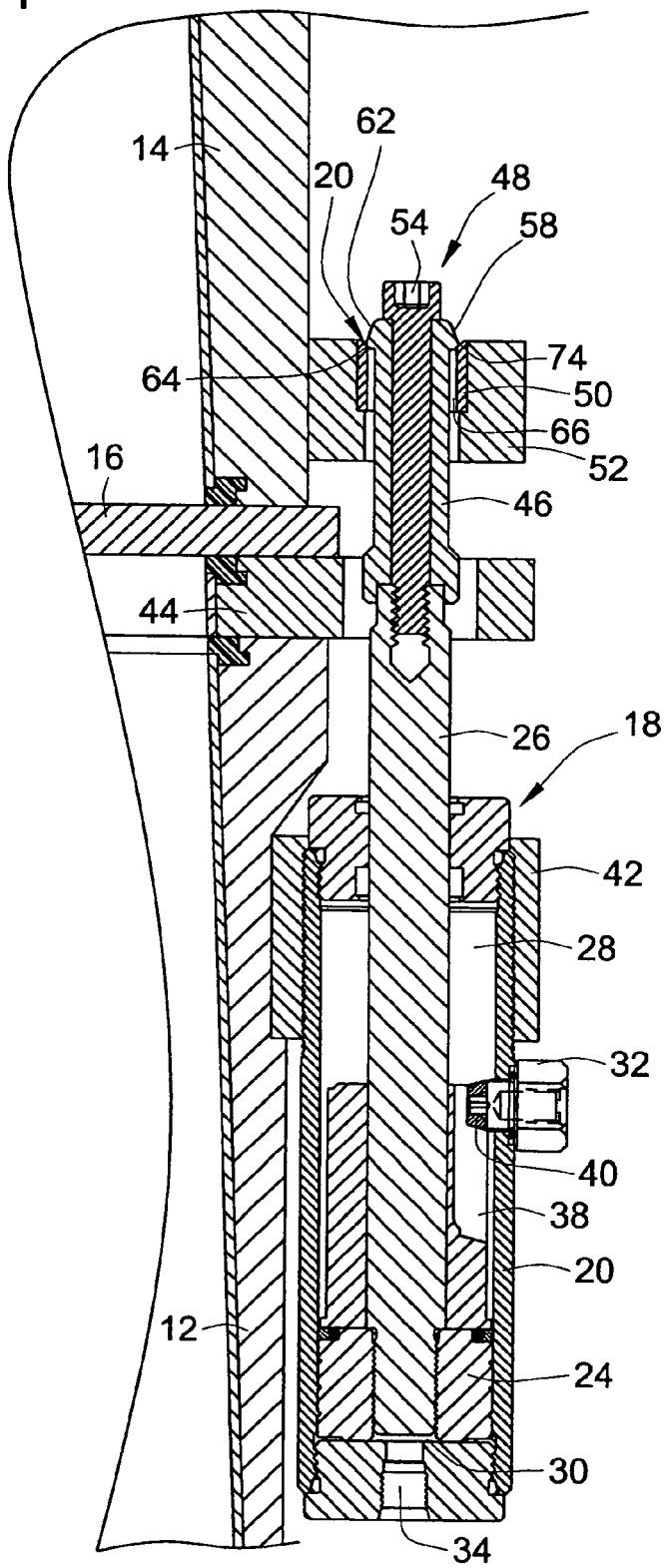
FIGS. 11 and 12 are cross sections of the automated clamping mechanism, shown in the clamped and released positions, respectively.
Figure 12A:
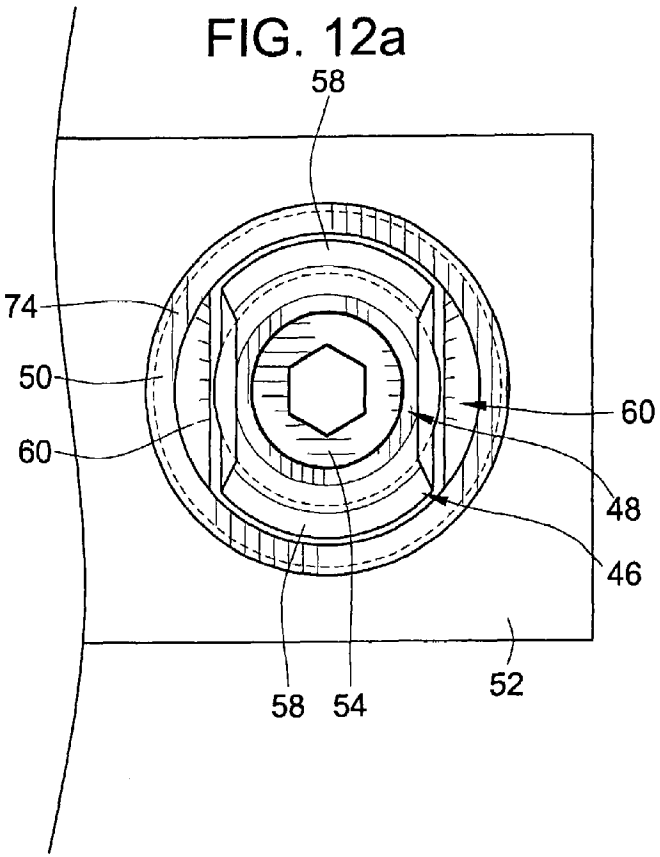
FIGS. 11*a* and 12*a* are partial enlarged top views of the clamping mechanism depicted in FIGS. 11 and 12, in the clamped and released positions, respectively.
Figure 11A:
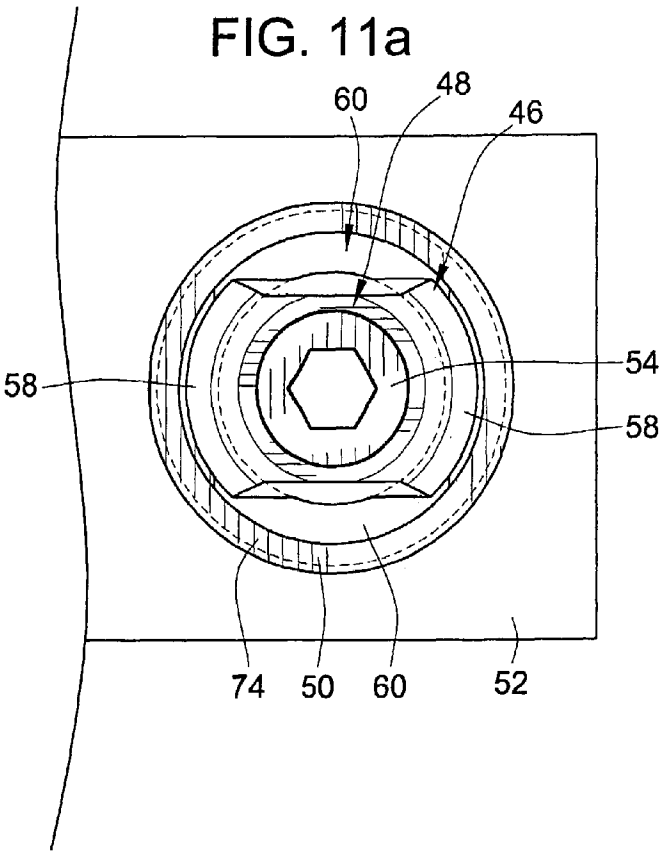
Figure 12:
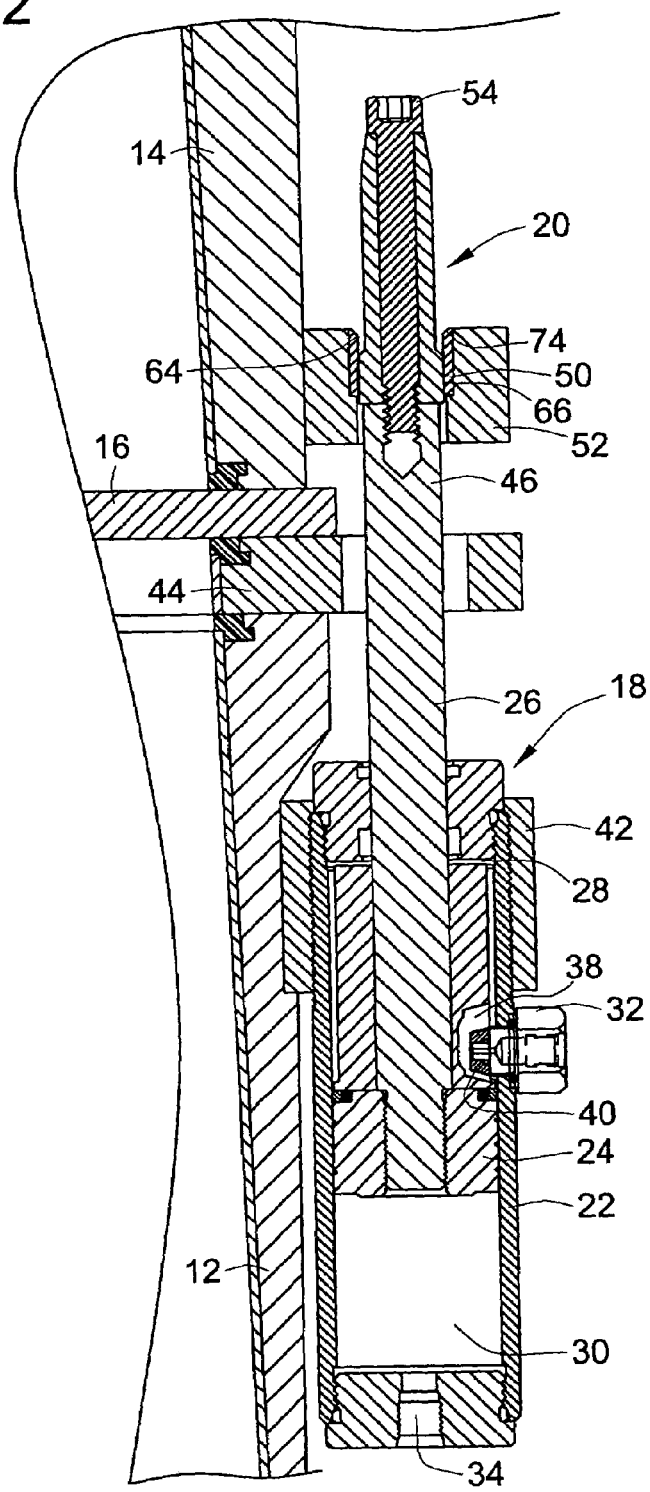

Referring to FIG. 2-3 and 11-12, the automated clamping mechanism 10 comprises an actuator, which as shown in the preferred embodiments may take the form of a combination rotary and linear hydraulic cylinder 18. The hydraulic cylinder 18 drives a clamp assembly generally indicated at 20 (that includes opposed clamping abutments) between released and clamped positions as shown in FIGS. 11-12. The hydraulic cylinder 18 includes a cylindrical barrel 22, a piston 24 linearly slidable and rotatable in the barrel 22, and a hermetically sealed shaft 26 projecting from one end of the barrel 24. The piston 24 divides the hollow interior of the barrel 22 into an upper fluid chamber 28 and a lower fluid chamber 30. Port fittings 32, 34 mounted into the barrel 24 provide for fluid communication into and out of the barrel 24 to provide for hydraulic actuation.

Figure 1:
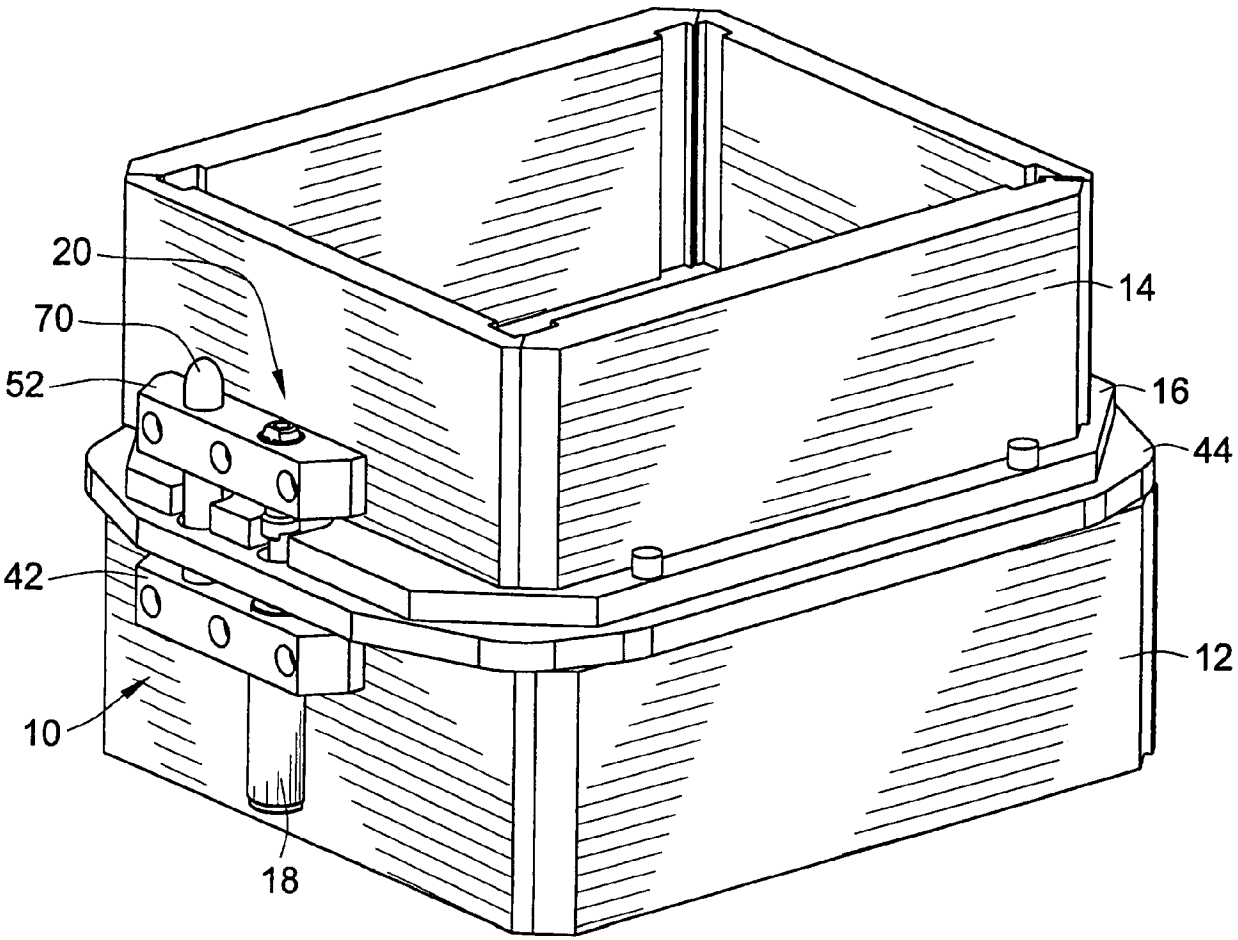
FIG. 1 is an isometric view of a mold flask assembly incorporating an automated clamping mechanism according to a first embodiment of the present invention, in which the clamping mechanism secures the cope flask and drag flask together with the pattern plate therebetween.
Figure 2:
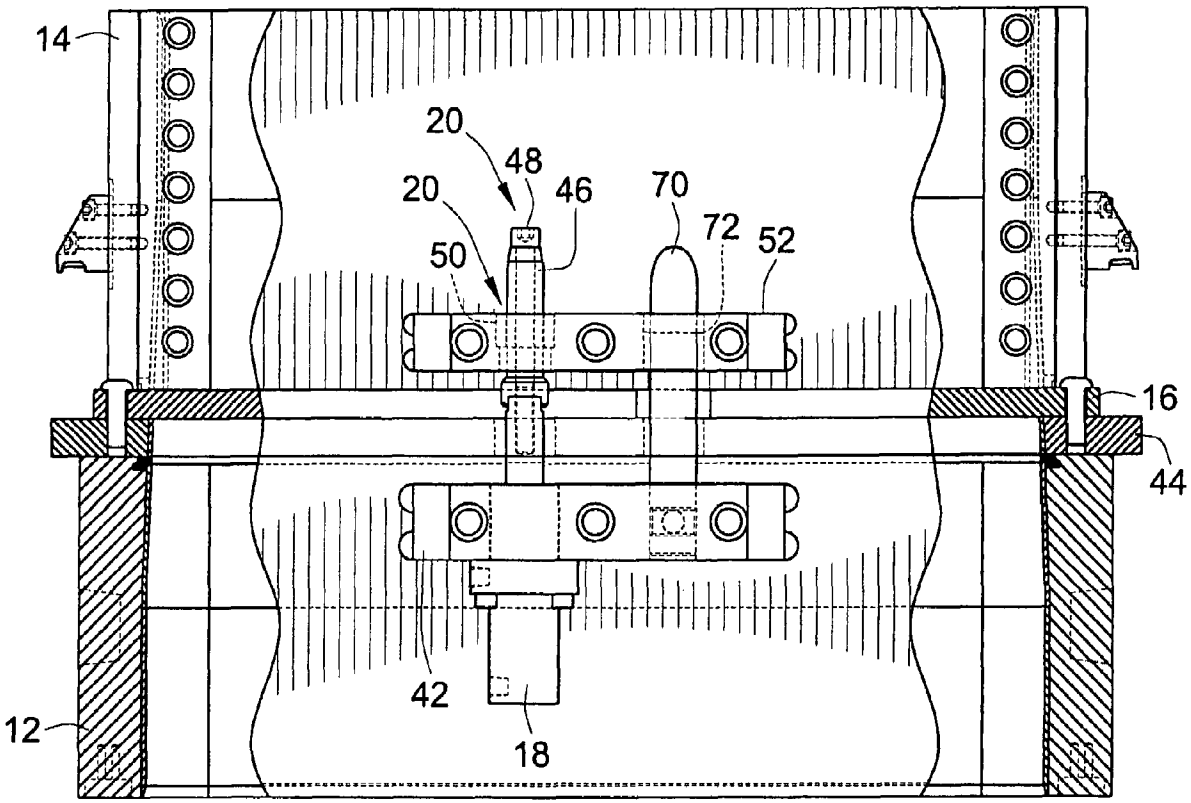
FIG. 2 is a side view (shown in partial cross section) of the mold flask assembly and automated clamping mechanism as shown in FIG. 1.
Figure 3:
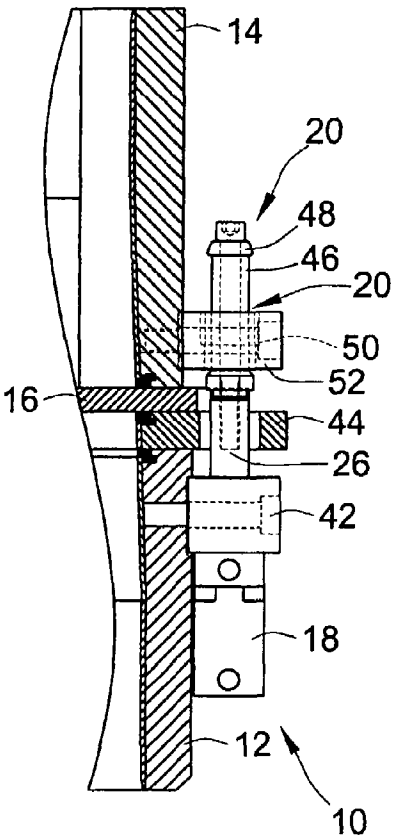
FIG. 3 is a cutaway cross section of FIG. 2.
Figure 4:
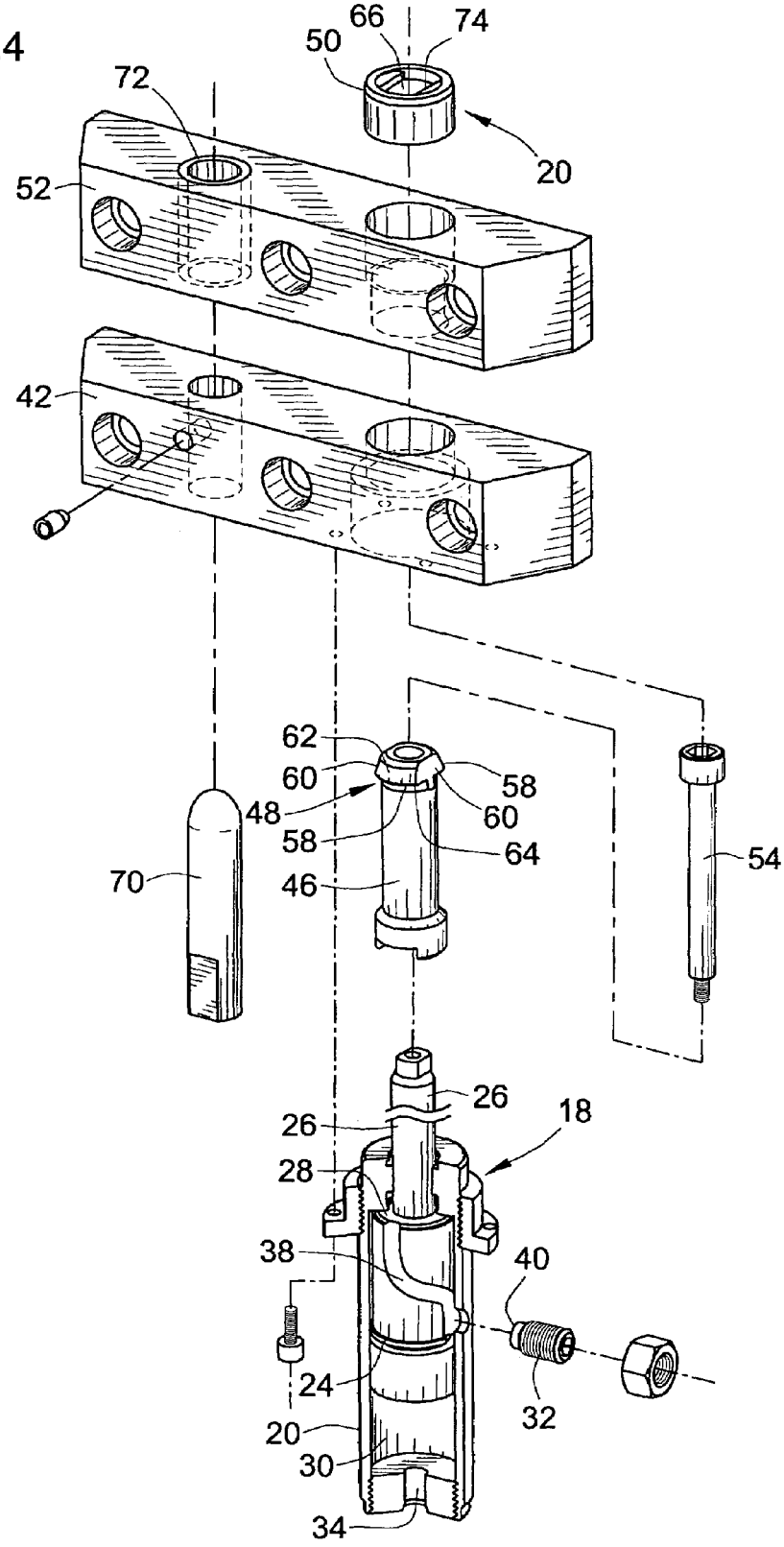
FIG. 4 is an exploded perspective assembly view of the automated clamping mechanism and associated components.
Figure 5:
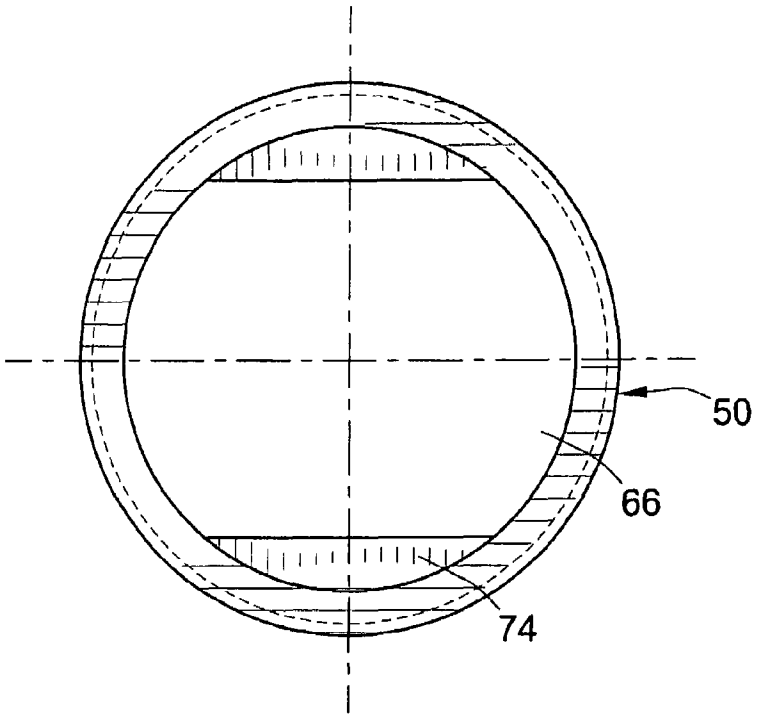
FIG. 5 is an end view of the slotted bushing of the automated clamping mechanism.
Figure 6:
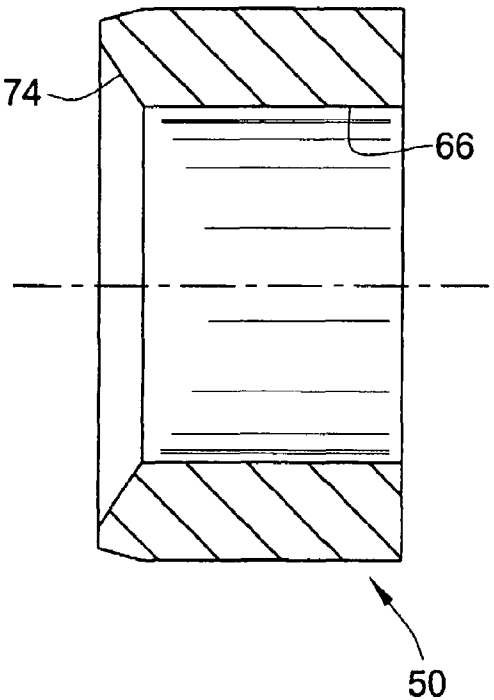
FIG. 6 is a cross section of the slotted bushing shown in FIG. 5.
Figure 9:
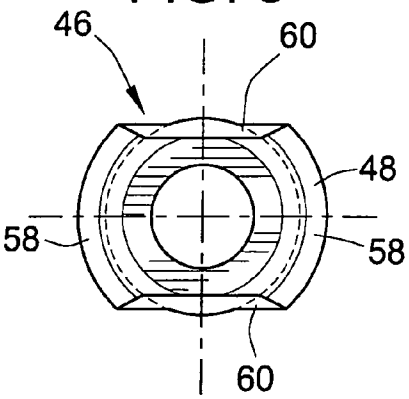
FIGS. 7-10 are side, top, bottom, and side views of the clamping rod of the automated clamping mechanism.
Figure 7:
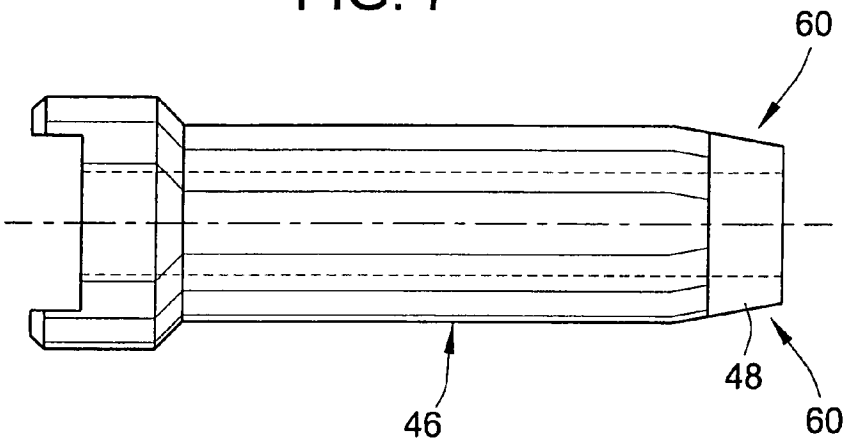
Figure 8:
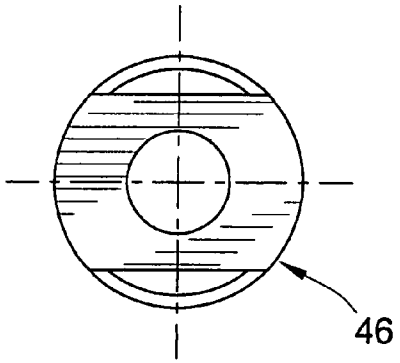
Figure 10:
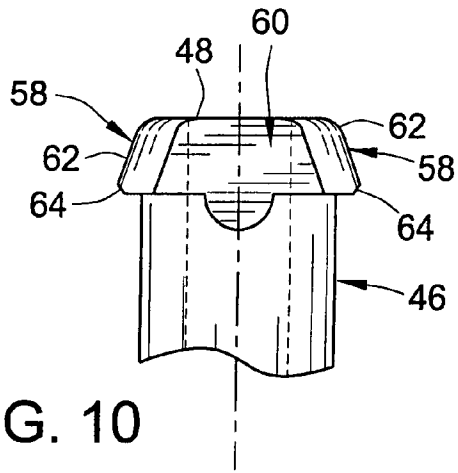

The actuator of a preferred embodiment provides both linear and rotary movement. As shown in FIGS. 4, 11-12, the hydraulic cylinder 18 comprises a cam mechanism between the barrel 22 and an upper cam segment portion 36 of the piston 24. The cam mechanism may include a groove shaped cam track 38 formed into the upper segment portion 36 of the piston 24 and an actuating projection 40 formed on the end of the upper port fitting 32 that is received into the cam track 38. The groove shaped cam track 38 is sufficiently deep, and thereby also serves a flow passageway to provide fluid communication between the upper port fitting 32 and the upper chamber 28. During and in response to linear movement of the piston 24 by virtue of a pressure differential created by selective pressurization of the opposed fluid chambers 28, 30, the actuating projection 40 engages the cam track 38 and automatically causes gradual rotation of the piston between predetermined angular positions. The upper and lower segments of the cam track 38 may be offset by ninety degrees as shown which in turn causes a ninety degree rotation between fully extended and fully retracted positions, which correspond to released and clamped positions.

A mounting bracket 42 mounts the hydraulic cylinder 18 to the drag flask 12. The mounting bracket 42 is fastened to the drag flask 12 and secures the hydraulic cylinder 18 at a vertical orientation such that the actuated shaft 26 projects vertically upward. The mounting bracket 42 also horizontally spaces the hydraulic cylinder 18 and clamp assembly 20 to provide sufficient clearance for the pattern plate 16 to be located in place. The pattern plate may be secured to a bolster plate 44. The bolster plate 44 has a large central opening to allow the pattern of the pattern plate 16 to be fully exposed on the inside of the flask assembly. The bolster plate 44 also includes a through hole through which the shaft 26 of the cylinder 18 passes.

In this embodiment, the clamp assembly 20 includes a clamping rod 48 mounted to the cylinder rod or shaft 26 (which combination forms an extended rod) and a slotted bushing 50 mounted to the cope flask 14 by a cope mounting bracket 52. The clamping rod 48 may be a sleeve shaped component as shown that is secured to the shaft 26 such as by the shoulder bolt 54 or can also be unitarily formed with the cylinder shaft 26. The clamping rod 48 may be keyed to the shaft 26 at the interface therebetween to prevent relative rotation therebetween. This provides a preset angular orientation for the clamping rod 48 that is dependent upon the position of the hydraulic cylinder 18.

The clamping rod 46 includes a clamping head 56 that provides outwardly projecting shoulders 58. The shoulders 58 provide a clamp abutment for clamping against the slotted bushing 50. The shoulders are angularly spaced about the actuation axis and separated by clearance gaps 60. Chamfered faces 62, 64 are provided on front and back sides of the clamping head 56. The chamfered faces 62, 64 when engaged tend to center and keep axial alignment of the clamping rod and head 56 along the actuation axis to better ensure proper release and clamping when desired.

The slotted bushing 50 can be pres fit and/or secured (e.g. with a set screw) in a formed counter bore in the cope mounting bracket 52. The slotted bushing 50 includes a slotted opening 66 with a pair of opposed flat walls and a pair of opposed partially circular walls. The shoulder structures of the clamping head 56 have a configuration complimentary to the shape of the slotted opening 60 such that the clamping head 56 can linearly slide through the slotted opening for release with the proper angular orientation of the released position shown in FIG. 12. The clamping rod 46 has diameter complementary to the distance between opposed flat walls of the central opening 66, such that the clamping rod 46 can linearly slide and rotate within the bushing 50. The slotted bushing 50 also includes shoulders 68 which provide a counter clamping abutment for coacting with the shoulders 58 provided by the clamping head 56.

The hydraulic cylinder 18 linearly drives the clamping head 56 relative to the slotted bushing 50 between clamped and released positions, as shown in FIGS. 11 and 12. When in the released or extended position shown in FIG. 12, the shoulders 68 of the slotted bushing and the shoulders 58 of the clamping head 56 are spaced axially along the axis and also are rotated ninety degrees relative to each other, such that the cope flask 14 and drag flask 12 may be pulled apart vertically to disassemble the mold flask assembly. The released or extended position unclamps the pattern plate 16 and allows the pattern plate 16 to be switched out if desired.

During disassembly of the mold flask, the opposed shoulders 68, 58 of the clamping head 56 and the slotted bushing 50 are angularly offset such that the clamping head 56 slides smoothly through the slotted bushing. Preferably guide pins 72 are provided for guiding the disassembly. The guide pins 72 are mounted to the drag mounting bracket 42 in parallel relation to the hydraulic cylinder 18 and clamping rod 46. Each guide pin 72 slidably engages a guide bushing 72 mounted in the cope flask bracket 52 in parallel relation to the slotted bushing 50. The guide pins 72 have a chamfered and more specifically tapered tip to direct automatic alignment during linear movement. The chamfers 62, 64 on the clamping head 56 also provide an alignment means, as does the chamfer 74 on the slotted bushing 50.

When the mold flask is vertically assembled with the pattern plate 16 trapped between the drag and cope flasks 12, 14, the pattern plate 16 can be securely clamped therebetween by retracting the hydraulic cylinder 18 toward the clamped position shown in FIG. 11. The movement of the hydraulic cylinder 18 from the extended position to the retracted position rotates the clamping head 48 ninety degrees such the shoulders 68 of the slotted bushing and the shoulders 58 of the clamping head 56 come into alignment with each other. Additionally, the end of the movement causes clamping engagement between the shoulders 68 of the slotted bushing and the shoulders 58 of the clamping head 56. Chamfers 74, 64 assist in ensuring proper centering and alignment during clamping engagement.

As shown in FIG. 13, the clamping flask assembly has been incorporated into an automated matchplate molding machine 80. In this molding machine 80, one or more mold flask assemblies (including the cope and drag flasks 12, 14) are carried on and cyclically rotated on a turnstile 84 between a sand filling station 86 and a mold flask assembly/disassembly and mold release station 88, as described in further detail in U.S. Pat. No. 6,622,722. Since the turnstile 84 rotates-back and forth in opposite directions (rather than one direction), the hydraulic lines (not shown) leading to the hydraulic cylinder 18 can be carried by the turnstile 84 and routed along the drag flask 12.

Another embodiment of the invention is shown in FIGS. 14-17. In this embodiment, one and preferably several clamping mechanisms 110 are mounted to a drag flask 112 for clamping a pattern plate 116 thereto. A cope flask 114 can then be assembled thereto to complete a flask assembly. In this embodiment, and unlike the previous embodiment, the clamping mechanisms 110 are not operated when sand molds are being successively made with the same pattern plate, but instead the clamping mechanisms 110 are operated when it is desired to switch out the pattern plate with a different pattern plate (e.g. switching between jobs). This clamping mechanism 110 thus provides a quick pattern change feature and eliminates a substantial amount of manual labor and associated downtime associated with switching pattern plates.

Figure 15:
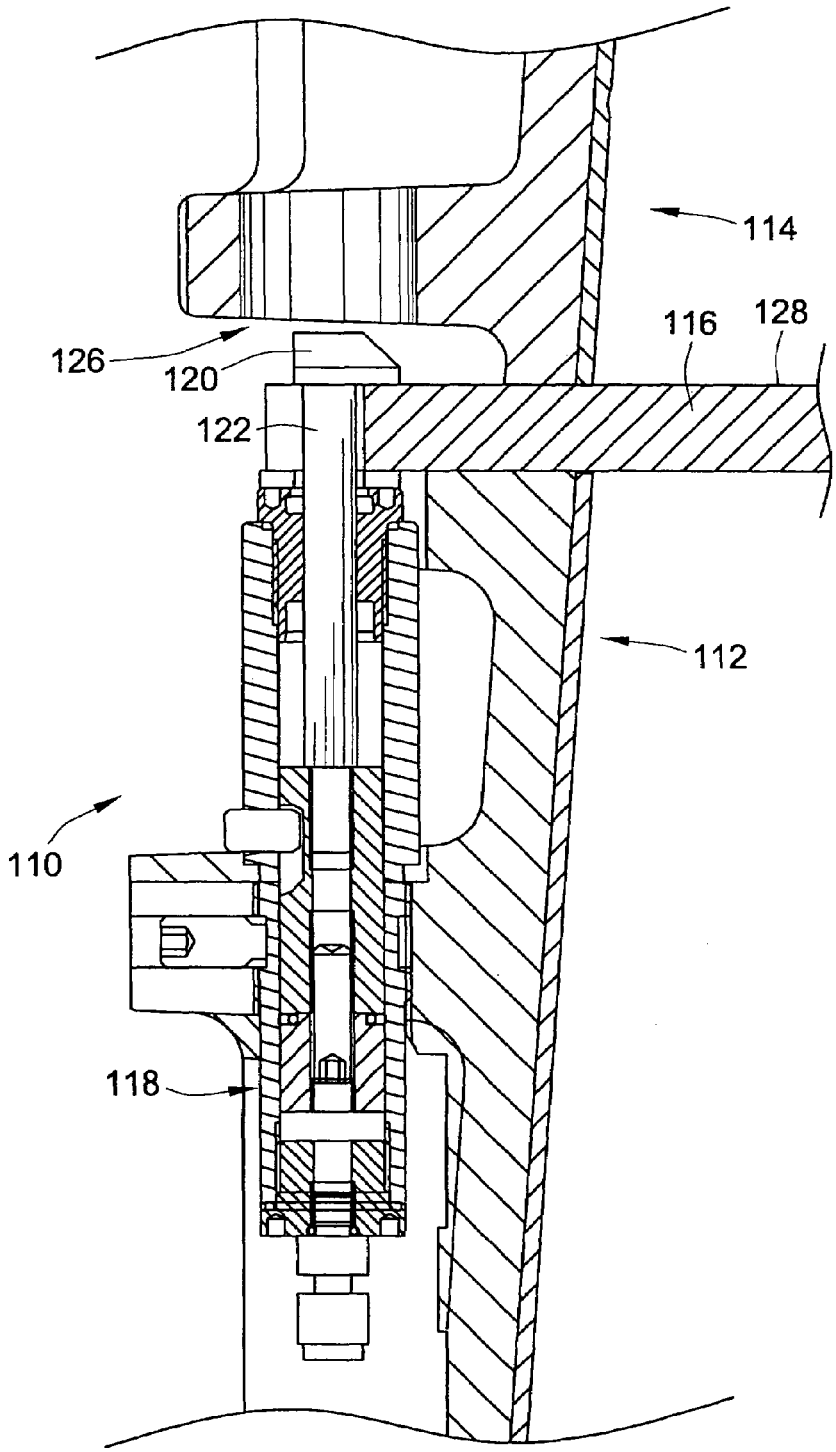
FIGS. 15 and 16 are enlarged cross section of a portion of FIG. 14, better illustrating one of the clamping mechanisms shown in FIG. 14, with different positions shown to show clamped and released positions, respectively.
Figure 16A:
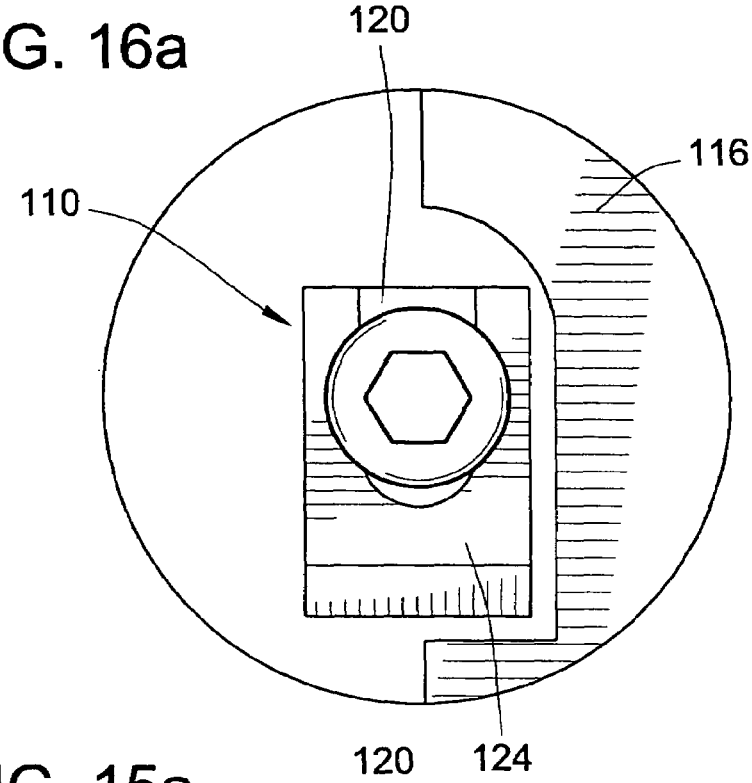
FIGS. 15*a* and 16*a* are top enlarged views of the clamping mechanism in the clamped and released positions, respectively.
Figure 15A:
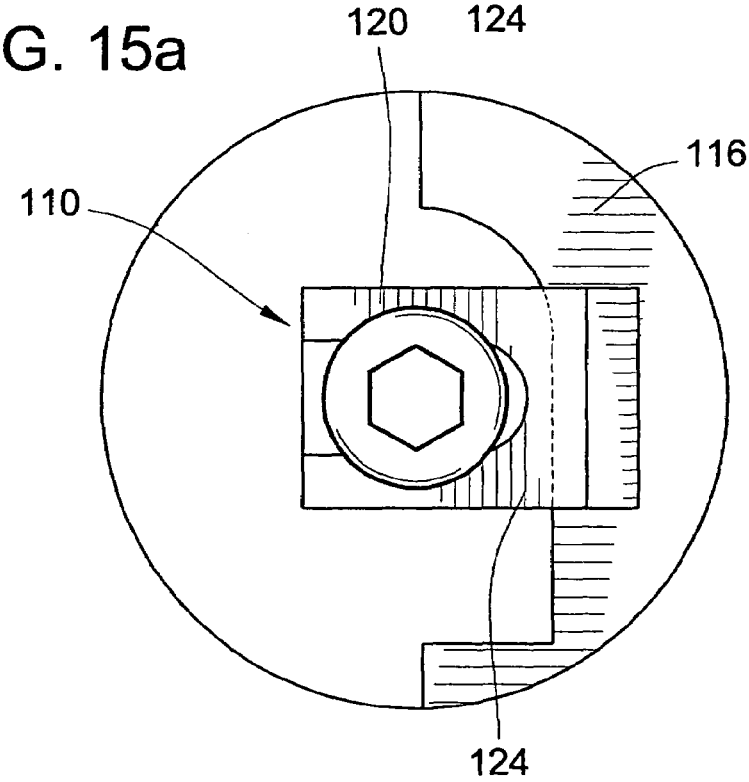
Figure 16:
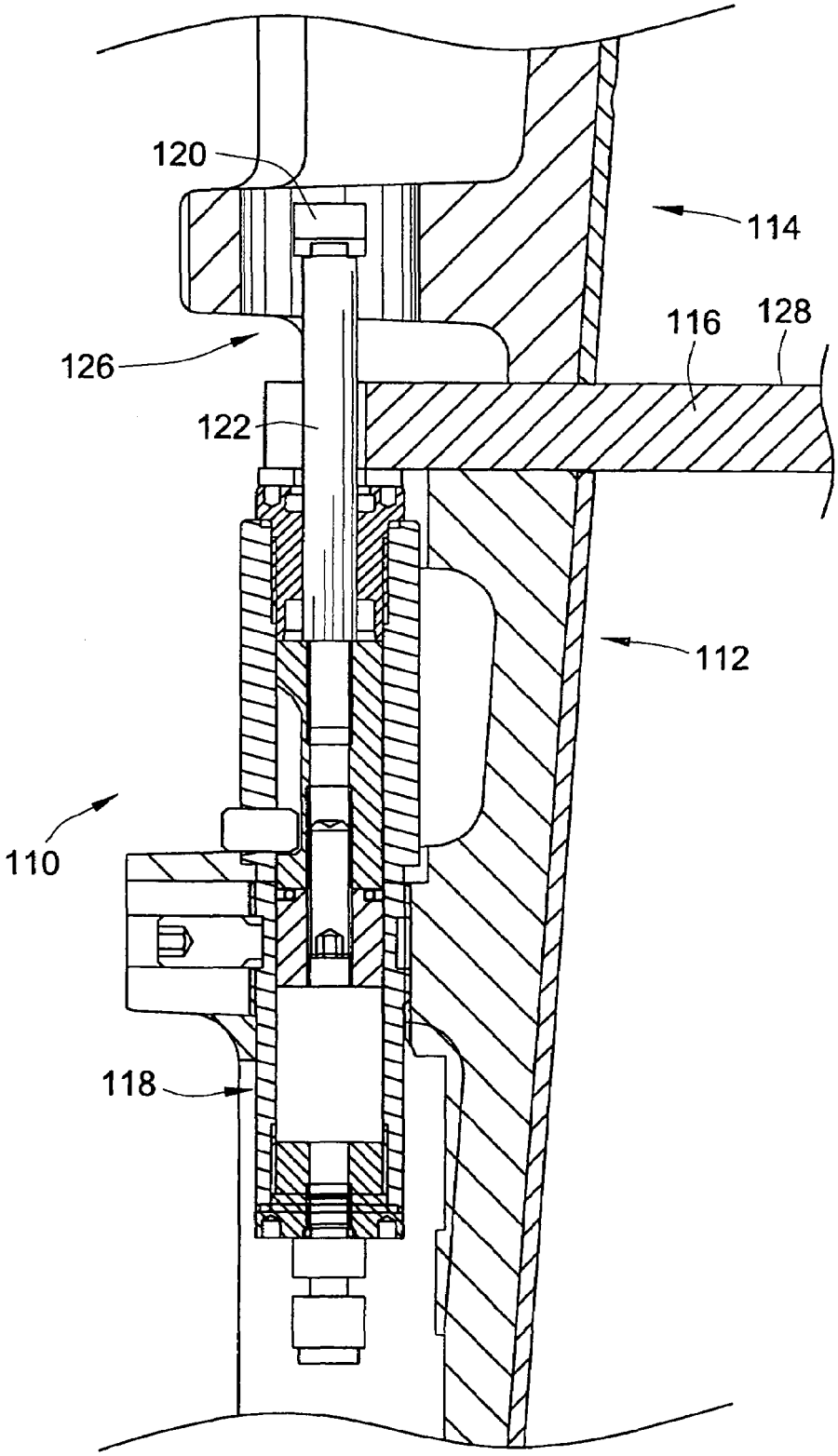

The clamping mechanism 110 of this embodiment may also include a combination rotary and linear actuator 118, which may be the same or similar to the hydraulic cylinder 18 of the first embodiment. The actuator 118 has an extended position as shown in FIG. 16 and a retracted position as shown in FIG. 15, which are linearly displaced and angularly displaced by ninety degrees. The clamping mechanism 110 also includes a clamping head 120 secured to the shaft 122 of the actuator 118. The clamping head 120 provides a flange abutment 124 that projects outwardly and provides a shoulder for engaging the pattern plate 116. The flange abutment 124 does not extend around the clamping head 120 but has a predetermined angular orientation relative to the actuator shaft 122 to provide for a clamped position as shown in FIG. 15 and a released position as shown in FIG. 16. To accommodate the clamping head 120, the cope flask 114 includes a clearance space 126 to provide clearance and prevent interference when the clamping mechanism 110 in the retracted position (and preferably also the extended position).

To install a pattern plate 116 on the drag flask 112, the drag flask 112 is positioned vertically upright such that it provides a horizontally flat top surface 128 (or alternatively horizontally oriented such that the top surface 128 is in the vertical plane). In the vertically oriented position, the clamping actuators 118 are in the extended position such that the flange abutments 124 of the clamping heads 120 face to the side or away from the center of the drag flask 112 as shown in FIGS. 16 and 16*a*.With the clamping heads 120 rotated, clearance space is provided between the clamping heads 120 of different clamping mechanisms 110 to vertically maneuver the pattern plate 116 onto the top surface 128 of the drag flask 112.

Locating means is preferably provided for guiding, locating and centering the pattern plate 116 on top surface 128 such as one or more guide pins 130 and corresponding bushings 132. The guide pins 130 preferably are mounted to the body of the drag flask 112 and project vertically upward and provide a tapered tip above the top surface 128. The guide pins 130 also preferably project above the clamping heads 120 when the actuators are extended such that the pattern plate 116 will typically not contact or interfere with the clamping mechanisms 110 during placement of the pattern plate 116 on the drag flask 112. Corresponding clearance holes 134 or such clearance means is provided in the cope flask 114 such that when the drag flask 112 and cope flask 114 are assembled, the guide pins clear the cope flask 114.

The corresponding bushings 132 are mounted in formed holes in the pattern plate 116 and are slidably received on the pins 130 during placement of the pattern plate 116. The inner diameter of the bushings 132 provide an inner diameter that closely corresponds to the outer diameter of the guide pins 130 at or proximate the top surface 128 to provide for proper location and centering of the pattern plate 116 on the drag flask 112.

Once the pattern plate 116 is located on the drag flask 112, the clamping mechanisms 110 can be actuated to the retracted clamped position shown in FIG. 15. The retracting movement of the actuator 118 rotates and linearly drives the flange abutment 124 of each clamping head 120 over and into clamping engagement with the top surface of the pattern plate 116 (the top surface of which provides a cooperating clamp abutment). This secures the pattern plate 116 to the drag flask 112. When it is desired to remove the pattern plate 116, the above steps are conducted in reverse. Specifically, the actuators 118 of the clamping mechanisms 110 are actuated to the extended or release position to unclamp the pattern plate 116. Then the pattern plate 116 can be vertically lifted off the drag flask 112.

Figure 17:
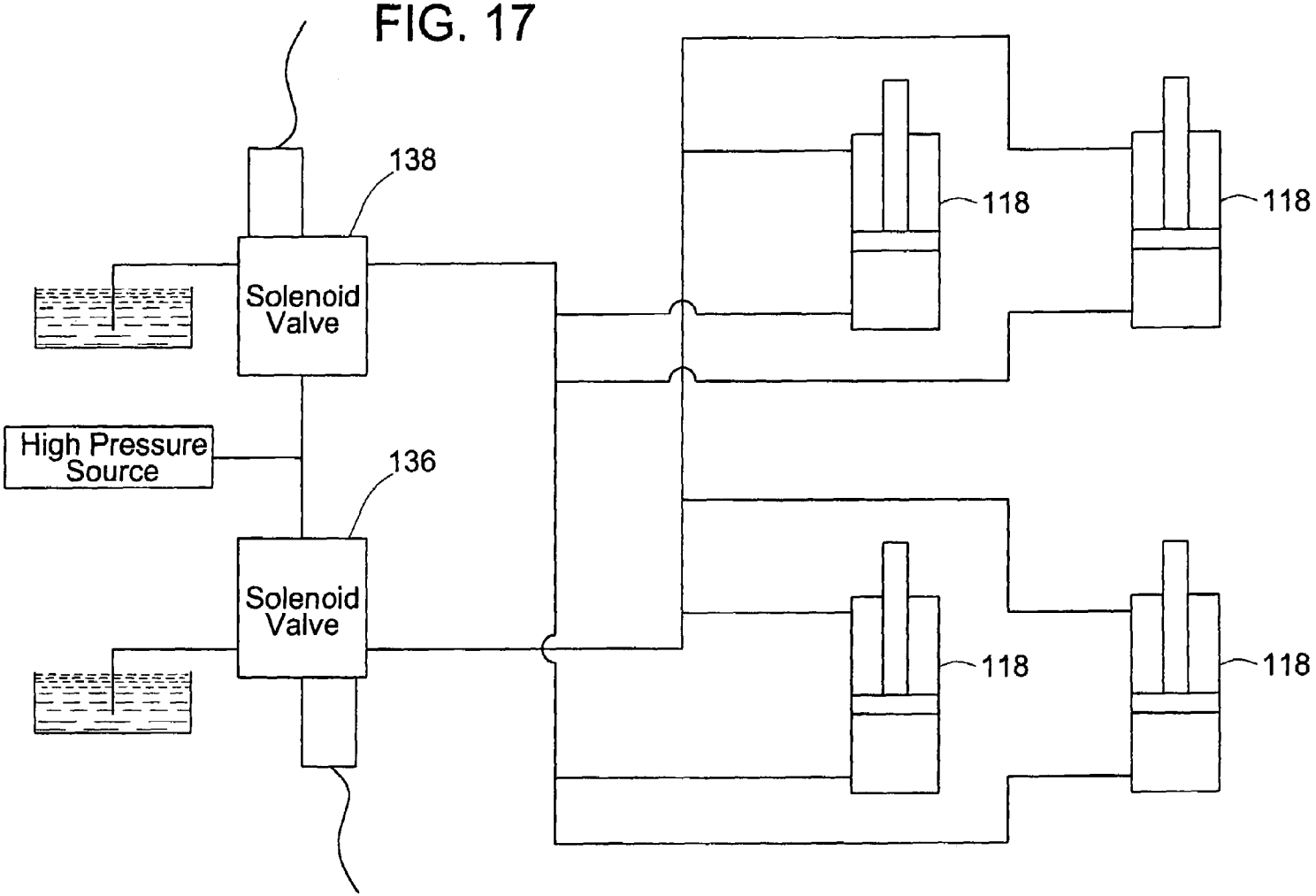
FIG. 17 is a schematic illustration showing how the fluid actuators of the clamping mechanism are actuated in the second embodiment.

A fluid schematic is shown in FIG. 17, which schematically illustrates the actuation of the actuators 118 of the clamping mechanisms 110. As shown, engage solenoid valves 136 are fluidically coupled to the top chambers of each actuator 118, while a disengage solenoid valve 138 is fluidically coupled to the lower chambers of each actuator 118. Each solenoid valve 136, 138 is operable to couple their respective chambers either to a drain/sump (or vent in the case of air), and a high pressure fluid source such as a hydraulic pump or pressure pot. A spring (not shown) may also be placed in the upper chamber of each actuator 118 if desired in order to maintain the clamping mechanisms 110 in the clamped position upon pressure loss or other failure.

Figure 18:
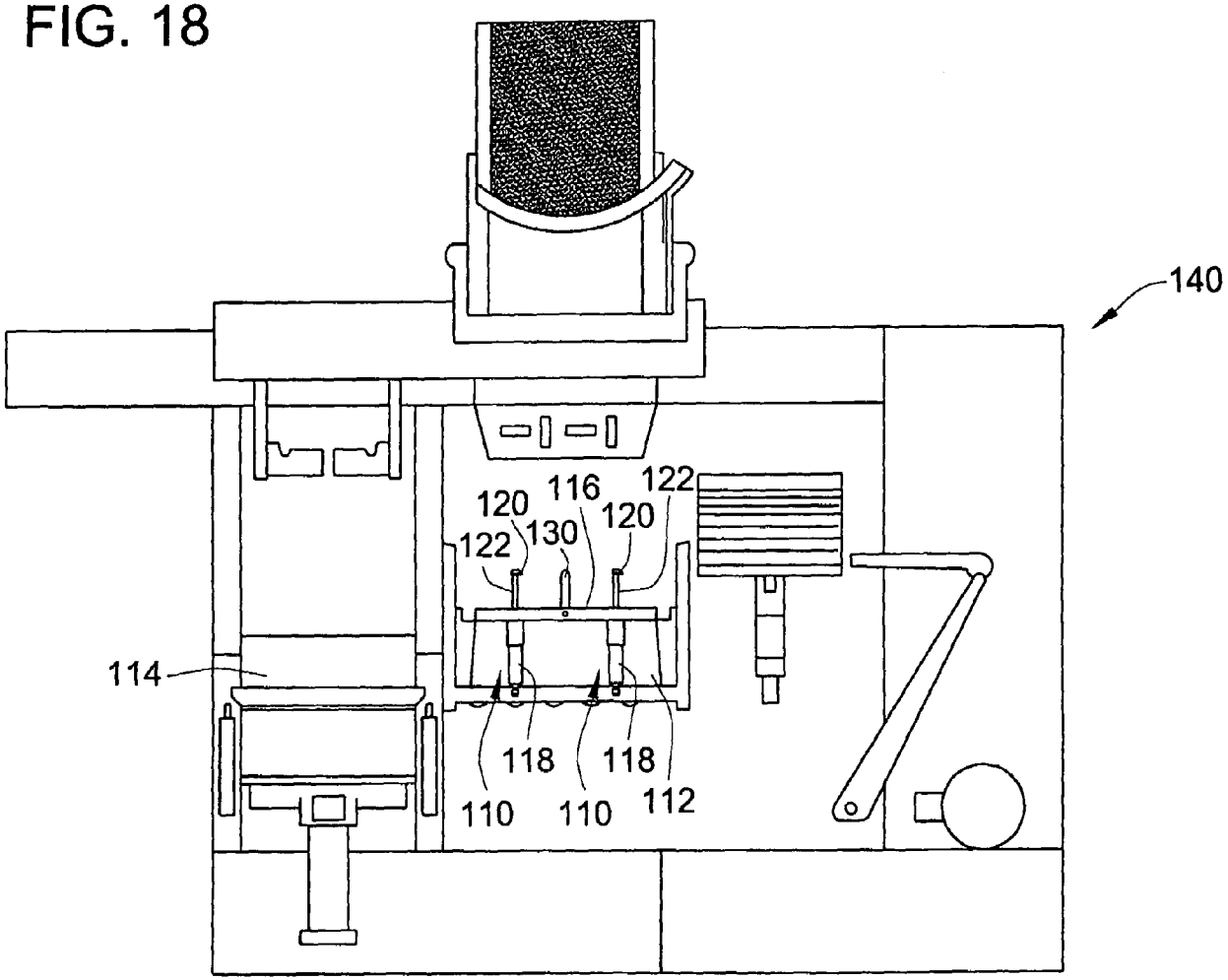
FIG. 18 is a partly schematic illustration of an automated matchplate molding machine incorporating the first embodiment.

The clamping mechanism 110 of this second embodiment has particular application to the Hunter® HMP et seq. model molding machines 140, a partially schematic illustration of which is shown n FIG. 18. Additional reference can be had to U.S. Pat. Nos. 5,022,512, 4,840,218 and 4,890,664. It should be noted that the first embodiment of the clamping mechanism 10 can be used for clamping the pattern plate to the drag flask, in which the slotted bushing may be mounted directly into the pattern plate All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary, language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An apparatus, comprising:

a cope flask;

a drag flask;

a pattern plate positionable between said cope flask and drag flask and having a pattern thereon adapted to create a cavity in a mold;

at least one actuatable clamping mechanism for clamping the pattern plate to at least one of the cope flask and the drag flask, said clamping mechanism including an actuator having a linearly moveable shaft and a clamp fixed to the shaft;

said actuator being mounted on one of the drag and cope flasks, said actuator being selectively actuatable for moving said rod and clamp between a clamping position with said clamp in engaging relation with one of the other of said drag and cope flasks or said pattern plate for clamping and retaining said pattern plate and a released position in which said clamp is in disengaged relation to said one of said other drag and cope flasks or said pattern plate.

2. The apparatus of claim 1, wherein the actuator is mounted to the drag flask, and the clamp includes a clamping head, the clamping head cooperating with a clamp abutment to provide a clamping force upon the pattern plate in the clamped position.

3. The apparatus of claim 2, wherein the actuator is a fluid actuator.

4. The apparatus of claim 3, wherein the fluid actuator includes a barrel and a piston slidable therein, the piston dividing the barrel into first and second fluid chambers, the shaft and clamping head carried by the piston, further comprising a cam mechanism between the piston and the barrel, the cam mechanism facilitating an angular rotation of the piston movement between the released and clamped positions during a linear movement of the piston, and wherein the clamping head includes a clamp counter abutment that aligns and misaligns with the clamp abutment when rotated between the clamped and released positions, respectively.

5. The apparatus of claim 4, wherein the clamping head projects through a slotted bushing and defines outwardly projecting first shoulders, the first shoulders providing the clamp counter abutment, the slotted bushing including second shoulders providing the clamp abutment, the first shoulders sliding through the bushing in the released position and engaging the second shoulders in the clamped position.

6. The apparatus of claim 5, further comprising chamfer means between the slotted bushing and the clamping head, for coaxially aligning the clamping head and the slotted bushing.

7. The mold flask assembly of claim 5, further comprising a drag mounting bracket securing the actuator to the drag flask and a cope mounting bracket securing the bushing to the cope flask.

8. The mold flask assembly of claim 7, further comprising guide pin means generally parallel to the automated clamping mechanism for vertically aligning the cope and drag flasks during assembly.

9. The apparatus of claim 4, wherein the fluid actuator is a hydraulic cylinder, and wherein the hydraulic cylinder includes a hydraulic port fitting extending through the barrel and into a cam track formed into the piston, to provide said cam mechanism, the hydraulic port fitting providing fluid communication through the barrel to one of the fluid chambers.

10. The mold flask assembly of claim 2, wherein said at least one clamping mechanism comprises a first of said clamping mechanism on a first side of the drag flask and a second of said clamping mechanism on a second and opposite side of the drag flask.

11. The mold flask assembly of claim 1, wherein the clamping mechanism releasably secures the pattern plate to one of the cope and drag flasks, the cope and drag flasks being movable relative to each other independent of the clamping mechanism in the clamped position.

12. The mold flask assembly of claim 1, wherein the clamping mechanism secures the pattern plate between the cope and drag flasks, wherein the cope and drag flasks are secured to each other by the clamping mechanism in the clamped position.

13. The mold flask assembly of claim 1, wherein the actuator is a combination rotary and linear actuator driving the clamping head between two angular positions and axially spaced positions.

14. The mold flask assembly of claim 13, wherein a clamp abutment is provided by a surface of the pattern plate, wherein the at least one clamping mechanism clamps the pattern plate to the drag flask, the at least one clamping mechanism being operated to selectively change the pattern plate clamped to the drag flask.

15. The mold flask assembly of claim 14, wherein a plurality of the clamping mechanisms are arranged along at least two different sides, of the drag flask, and wherein the pattern plate is located between clamps of the different clamping mechanisms, the clamps being rotated out of the way so as to allow placement of the pattern plate on the drag flask in the released position, the clamps being rotated into clamping contact with the pattern plate in the clamped position.

16. The mold flask assembly of claim 14, further comprising locating means for locating the pattern plate on the drag flask, the locating means including a pin and hole mechanism between the pattern plate and the drag flask.

17. The apparatus of claim 14, wherein the fluid actuator is a hydraulic cylinder, and wherein the hydraulic cylinder includes a hydraulic port fitting extending through the barrel and into a cam track formed into the piston, to provide said cam means, the hydraulic port fitting providing fluid communication through the barrel to one of the fluid chambers.

18. The apparatus of claim 1 in which said actuator is a combination rotary and linear actuator operable for effecting both linear translation and rotational movement of said rod and clamp between said clamped and released positions.

19. The apparatus of claim 18 in which said clamp defines a first clamp abutment, and a second clamp abutment defined by said one of said other of said drag and cope flasks or said pattern plate, and said first clamp abutment being movable in response to actuation of said actuator between said clamped position in engagement with said second clamp abutment and said released position linearly and angularly disposed relative to said second clamp abutment.

20. The apparatus of claim 1 in which said clamp is movable in response to actuation of said actuator into and out of engagement with said pattern plate.

* * * * *